US012419405B2

(12) United States Patent
Herron et al.

(10) Patent No.: US 12,419,405 B2
(45) Date of Patent: Sep. 23, 2025

(54) BACKPACK SYSTEM WITH INTEGRATED HEALTH AND PHYSICAL SAFETY COMPONENTS

(71) Applicants: Derrick Herron, Orlando, FL (US); Hope Herron, Orlando, FL (US); Esaias Herron, Orlando, FL (US)

(72) Inventors: Derrick Herron, Orlando, FL (US); Hope Herron, Orlando, FL (US); Esaias Herron, Orlando, FL (US)

( * ) Notice: Subject to any disclaimer, the term of this patent is extended or adjusted under 35 U.S.C. 154(b) by 0 days.

(21) Appl. No.: 17/945,628

(22) Filed: Sep. 15, 2022

(65) Prior Publication Data

US 2024/0090648 A1 Mar. 21, 2024

(51) Int. Cl.
*A45F 3/04* (2006.01)

(52) U.S. Cl.
CPC ..... *A45F 3/04* (2013.01); *A45F 3/042* (2013.01)

(58) Field of Classification Search
CPC .. A45F 3/02; A45F 3/042; A45F 3/047; A45F 2003/025; A45F 2003/045
USPC ..... 224/627–659, 153
See application file for complete search history.

(56) References Cited

U.S. PATENT DOCUMENTS

D203,869 S * 2/1966 Poris ..... D3/243
D250,793 S * 1/1979 Siegel ..... D3/243
4,269,315 A * 5/1981 Boyce ..... B65D 83/0847 422/1
4,506,769 A * 3/1985 Franco ..... A45C 13/02 190/110
4,550,856 A * 11/1985 Ballmann ..... B65D 83/00 128/202.13
4,673,084 A * 6/1987 Hubbard ..... B65D 85/18 206/440
4,739,809 A * 4/1988 Adams ..... A45C 3/06 206/823
4,815,640 A * 3/1989 Johnson ..... A45C 3/00 224/264
5,127,545 A * 7/1992 French ..... A45F 5/00 221/199

(Continued)

FOREIGN PATENT DOCUMENTS

AU 2011218406 A1 * 8/2012 ..... G01S 19/17
CA 2787964 A1 * 8/2011 ..... G01S 19/17

(Continued)

*Primary Examiner* — Justin M Larson
(74) *Attorney, Agent, or Firm* — Jason T. Daniel, Esq.; Daniel Law Offices, P.A.

(57) ABSTRACT

A backpack system includes a main body having a plurality of sides that define an interior space. The main body is constructed from a watertight and transparent material, and includes a disposable face mask pocket along one side. A first shoulder strap includes a pocket for storing and dispensing moist sanitizing wipes, and a second shoulder strap includes a pocket for storing a bottle of sanitizing solution having a pump-style dispenser. At least one light and a camera system is disposed along the main body. The camera system includes a digital camera, a speaker and a microphone. A system controller includes a location tracking module and a wireless communication unit. A mobile application communicates with the communication unit to receive audiovisual information and performs two way voice and video communications.

20 Claims, 5 Drawing Sheets

(56) References Cited

U.S. PATENT DOCUMENTS 5,255,833 A * 10/1993 McAllister ..... A45F 3/02 224/236
D351,062 S * 10/1994 Shapland ..... D3/242
5,615,767 A * 4/1997 Eull ..... B65D 85/18 206/499
5,651,152 A * 7/1997 Ritchie ..... A61G 7/05 5/663
D419,358 S * 1/2000 Marcon ..... D6/407
6,237,825 B1 * 5/2001 Pencoske ..... A45F 3/04 383/117
6,412,656 B1 * 7/2002 Placik ..... B65D 83/0805 221/33
6,550,635 B1 * 4/2003 King ..... A47K 10/42 221/33
6,763,970 B2 * 7/2004 Harris ..... B65D 83/0805 221/33
6,863,201 B2 * 3/2005 Esqueda ..... A45F 3/04 224/652
6,870,089 B1 * 3/2005 Gray ..... H01L 31/042 136/203
7,735,682 B1 * 6/2010 Cassel ..... A47K 10/38 221/24
8,002,115 B2 * 8/2011 Rappaport ..... A45C 15/00 150/112
8,225,442 B2 * 7/2012 Davis ..... A45C 9/00 5/655
9,854,897 B1 * 1/2018 Pelkey, Jr. ..... H01M 50/267
9,968,179 B2 * 5/2018 Patel ..... B65D 83/0805
10,130,163 B2 * 11/2018 Zhijian ..... A45F 4/02
10,349,790 B2 * 7/2019 Fulscher ..... A47K 10/42
D872,992 S * 1/2020 He ..... D3/217
10,574,071 B2 * 2/2020 Zhijian ..... H02J 7/342
10,681,970 B2 * 6/2020 McManus ..... A45F 3/04
D898,349 S * 10/2020 He ..... D3/217
10,986,911 B2 * 4/2021 Cotirla ..... A45F 3/04
D922,762 S * 6/2021 He ..... D3/217
D927,174 S * 8/2021 Dai ..... D3/217
11,198,554 B2 * 12/2021 Lien ..... B65B 35/50
D945,768 S * 3/2022 He ..... D3/217
11,259,611 B2 * 3/2022 Knittel ..... G08B 13/196
D954,429 S * 6/2022 Chen ..... D3/217
D956,411 S * 7/2022 Jin ..... D3/217
D968,073 S * 11/2022 Lin ..... D3/217
11,583,048 B2 * 2/2023 Schmidt ..... A45C 7/0027
11,607,028 B2 * 3/2023 Hoffmann ..... A45F 3/02
11,723,448 B2 * 8/2023 Gaytan ..... A47K 10/38 224/196
11,735,949 B2 * 8/2023 Zhijian ..... H02J 7/342 320/103
2002/0020729 A1 * 2/2002 Alter ..... A45C 5/02 224/629
2002/0040912 A1 * 4/2002 McHugh ..... A61B 50/30 221/45
2002/0084279 A1 * 7/2002 Lickstein ..... A47K 10/42 221/24
2005/0051567 A1 * 3/2005 Bell ..... A41D 13/1161 221/33
2005/0211719 A1 * 9/2005 Vani ..... A47K 10/426 221/63
2007/0062843 A1 * 3/2007 Rudd ..... B65D 83/0805 206/581
2014/0061273 A1 * 3/2014 Bullivant ..... A45F 3/04 224/576
2015/0041511 A1 * 2/2015 Powell ..... A45C 15/00 224/576
2016/0015156 A1 * 1/2016 Hunter ..... A45C 13/1092 224/603
2017/0303652 A1 * 10/2017 Tate ..... A45C 3/00
2019/0021418 A1 * 1/2019 Jury ..... A47K 10/32
2019/0265750 A1 * 8/2019 Crowder ..... G09F 21/026
2020/0217622 A1 * 7/2020 James ..... A45C 3/001
2022/0160112 A1 * 5/2022 Rodriguez ..... A45C 3/001
2022/0175119 A1 * 6/2022 Webb ..... A45F 3/047
2022/0202171 A1 * 6/2022 Vu ..... A45F 3/02
2024/0090648 A1 * 3/2024 Herron ..... A45C 13/02
2024/0090652 A1 * 3/2024 Herron ..... A45F 3/06

FOREIGN PATENT DOCUMENTS

CN 102870143 A * 1/2013 ..... G01S 19/17
CN 104643492 A * 5/2015
CN 107048679 A * 8/2017
CN 107125899 A * 9/2017
CN 107136736 A * 9/2017 ..... A45C 13/001
CN 107157084 A * 9/2017
CN 108175174 A * 6/2018
CN 108606443 A * 10/2018
CN 108703490 A * 10/2018
CN 108783826 A * 11/2018
CN 108926099 A * 12/2018
CN 109008166 A * 12/2018
CN 109349779 B * 12/2020 ..... A45C 13/001
CN 113633086 A * 11/2021
GB 2361174 A * 10/2001 ..... A45F 3/04
GB 2509206 A * 6/2014 ..... A45F 3/04
WO WO-0239846 A1 * 5/2002 ..... A45C 15/00

* cited by examiner

BACKPACK SYSTEM WITH INTEGRATED HEALTH AND PHYSICAL SAFETY COMPONENTS

TECHNICAL FIELD

The present invention relates generally to wearable storage devices, and more particularly to a backpack having a plurality of integrated health and physical safety features.

BACKGROUND

The statements in this section merely provide background information related to the present disclosure and may not constitute prior art.

Due to the recent Covid-19 pandemic, many individuals routinely carry some type of personal protective gear such as a mask or sanitizer, for example. For school aged children, parents often put a mask in the child's backpack when heading to school. Backpacks and other such devices are useful for providing users with the ability to carry a plurality of different items in a hands-free manner for long durations of time.

Unfortunately, recent events such as mass shootings have caused many schools and venues to prohibit individuals from carrying backpacks on the property to ensure the individual is not attempting to sneak a weapon. Separately, each day there are reports of another child going missing. In many cases, the child was heading to or from school when the abduction occurred.

The present invention, directed to a backpack system with integrated health and physical safety components aims to solve the above noted issues, and differs from the conventional art in a number of aspects. The manner by which will become more apparent in the description which follows, particularly when read in conjunction with the accompanying drawings.

SUMMARY OF THE INVENTION

The present invention is directed to a backpack system with integrated health and physical safety components. One embodiment of the present invention can include a main body having a plurality of sides that define an interior space. The main body can be constructed from a watertight and transparent material and can include a pocket for storing and dispensing disposable face masks. A pair of shoulder straps can be provided along the main body. One of the shoulder straps can include a pocket for storing and dispensing moist sanitizing wipes, and the other shoulder strap can store a bottle of sanitizing solution having a pump-style dispenser.

In one embodiment, a plurality of lights and a camera system can be disposed along the main body. The camera system can include a digital camera, a speaker, and a microphone for capturing audiovisual information. A system controller can be positioned within the main body and can be communicatively linked to the lights and the camera system. The controller can include a location tracking module and a wireless communication unit for communicating with a remotely located device.

In one embodiment, the system can include a mobile application for execution on a remotely located processor enabled device. The mobile application can include functionality for communicating with the communication unit to receive alarm information and audiovisual information captured by the camera system. In one embodiment, the mobile application can also utilize the camera system of the backpack to perform two-way voice and video communications.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
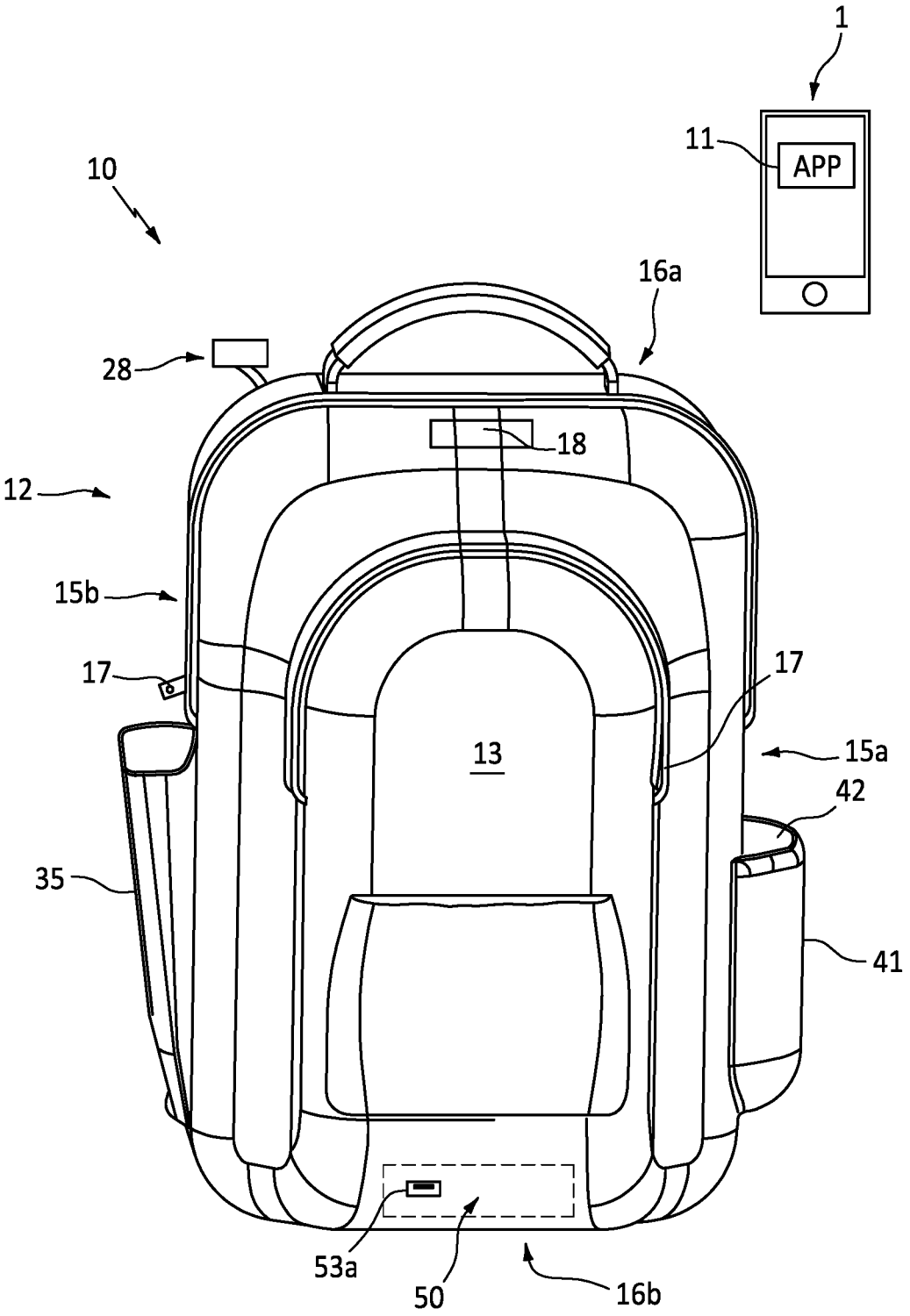
FIG. 1 is a front view of the backpack system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-5 illustrate one embodiment of a backpack system with integrated health and physical safety components 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of the backpack system 10 that includes, essentially, a mobile application 11 for execution on a user interface device 1, and a backpack 12.

As described herein, the user interface device 1 can include, comprise or consist of any type of processor interface device capable of sending and receiving information with the below described communication unit of the backpack. In the preferred embodiment, the user interface device will be a user-owned smartphone capable of running one or more client applications, such as a web browser, and/or an application interface, for example, for permitting communication with the backpack.

In one embodiment, the system can include a backpack safety mobile application (App) 11 that can be installed on the device 1. The mobile application can include functionality for communicating directly with the wireless communication unit of the backpack so as to allow the device user to see the location of the backpack, to see audiovisual information from the camera system of the backpack, to be alerted if/when the alarm of the backpack is activated, and/or to communicate using the backpacks onboard microphone and camera system.

Of course, the inventive concepts disclosed herein are not to be construed as limiting to a smartphone App, as virtually any type of instruction sets, in any form of programming language that can be executed on any type of user interface device 1 are also contemplated.

The backpack 12 can include a front surface 13, a back surface 14, a pair of opposing sides 15*a* and 15*b*, a top end 16*a*, and a bottom end 16*b*, that define an interior space. One or more zippers 17 or other such connectors are provided along the backpack body for selectively allowing access to the interior space. Although not specifically illustrated, the interior space can also include any number of different compartments and/or organizational elements.

The backpack body 12 can be manufactured to comprise any number of different shapes and sizes so as to be suitable for a wide array of different uses. In the preferred embodiment, the backpack body can be constructed from a transparent and water-resistant material such as flexible Polyvinyl Chloride (PVC), so as to be capable of being used at schools and venues requiring the use of clear bags. Of course, any number of other relatively see-through types of materials that are suitable for use in the manner described herein are also contemplated.

In one embodiment, one or more battery operated lights 18 can be provided along the backpack. The light(s) will preferably comprise LED-type lighting elements that are connected to the below described controller 50 and can be selectively activated via a user switch on the backpack and/or via the mobile application 11. Of course, any number of different type of lights can also be provided and can operate in any number of different colors and intensities.

Figure 2:
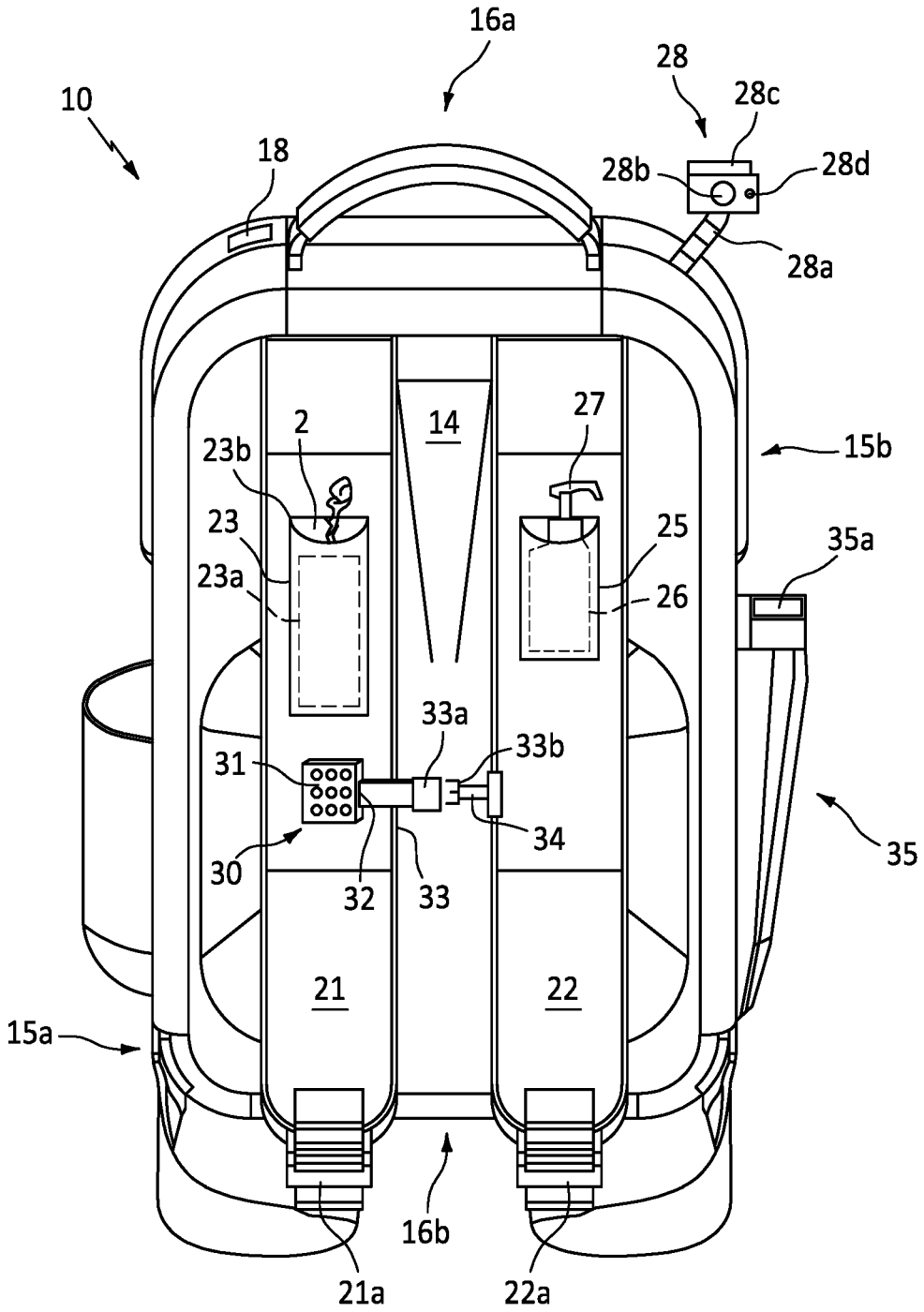
FIG. 2 is a back side view of the backpack system in accordance with one embodiment of the invention.

As shown best at FIG. 2, the backpack system 10 can include a pair of shoulder straps 21 and 22 which can be provided along the exterior of the backpack body. The shoulder straps can function in the expected manner to allow a wearer to position and carry the backpack on their back or shoulders. In various embodiments, the shoulder straps may be individually padded and can include adjustment mechanisms 21*a* and 22*a*, respectively, so as to be adjustable to any length desirable to a wearer.

In the preferred embodiment, the shoulder straps 21 and 22 can include a width of approximately 3.5 inches so as to cover the majority of the wearers chest while being worn. Moreover, each of the straps and the back surface 14 will preferably be constructed from—or lined with—a ballistic resistant material such as Kevlar, for example, so as to provide protection to the wearer in the event of an active shooter situation.

In one embodiment, a sanitizing wipe pocket 23 can be provided along the backpack, preferably along strap 21. The pocket 23 can be constructed from or can include a waterproof lining 23*a* for storing any number of moist sanitizing wipes 2 therein, and for preventing liquids associated with stored sanitizing wipes from leaking. As shown, the top portion of the pocket can include a resilient slit 23*b* for permitting the stored wipes to be individually dispensed. The resilient slit will preferably be constructed from rubber or other such material and will default in the closed position so as to prevent the wipes from being exposed to outside air when not being dispensed.

In one embodiment, a sanitizer bottle pocket 25 can be provided along the backpack, preferably along strap 22. The pocket 25 can function to receive a bottle of hand sanitizer 26 having a dispenser 27 along the top end thereof. The dispenser can include comprise or consist of any type of pump or battery-operated mechanism capable of discharging liquid or gel sanitizer stored within the sanitizer bottle onto a user's hands.

In one embodiment, the sanitizer bottle can be removably positioned within the pocket so as to removed and/or replaced with a different bottle. Alternatively, the bottle 26 can be permanently positioned within the pocket via adhesives or other such materials and can be refilled by removing the pump along the top of the bottle. Such a feature being advantageous to ensure the bottle does not become inadvertently separated from the backpack.

In one embodiment, a camera system 28 can be positioned along the backpack and can be oriented so as to face any direction via an adjustable arm 28*a*. In the preferred embodiment, the camera can include a digital camera having one or more lenses 28*b* for capturing still and motion images, a speaker 28*c* and a microphone 28*d*. The camera can be communicatively linked to the below described controller 50 and can function to capture audiovisual information which can be stored by the backpack's internal memory and/or relayed to a parent, guardian or third party in real time via the mobile application 11. To this end, the camera system can function with the mobile application and user device to perform two-way voice and video communications.

In one embodiment, the backpack can include an alarm device 30 that can be positioned along the shoulder strap 21. In one embodiment, the alarm device can include a housing having an integrated speaker 31 that is activated by a pull switch 32 which is connected to a tether 33. In one embodiment, the tether 33 can include one half of a buckle 33*a* along a distal end, and the second half of the buckle 33*b* can be connected to another tether 34 that is connected to the other shoulder strap 22.

The alarm device 30 can be communicatively linked to the controller 50 and can be selectively activated when the buckles are secured together and the first tether 33 is pulled away from the speaker body, thus activating the pull switch 32 as would occur if someone were to attempt to rip the backpack from the back of the wearer.

Of course, any number of other types of connectors may be utilized. Moreover, other embodiments are contemplated wherein the alarm device can be activated when the buckles are not secured together via a pulling motion on the tether 33 so as to engage the pull switch 32 which activates the alarm. In instances where the alarm is activated, the above-described camera system 28 can be automatically activated so as to capture audiovisual information about the alarm situation, and a notification can be sent to the mobile application 11.

Figure 3:
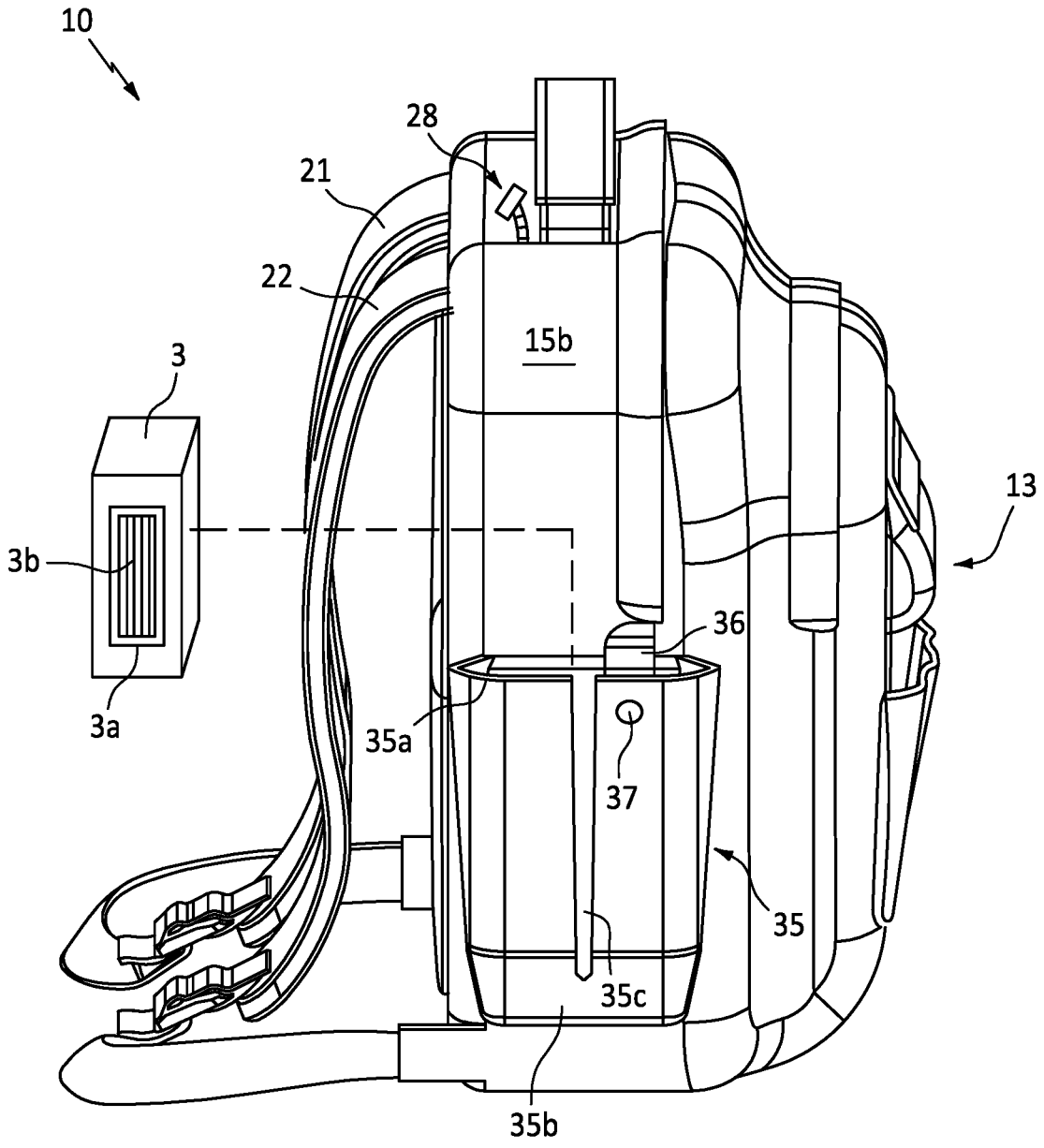
FIG. 3 is a side view of the backpack system in accordance with one embodiment of the invention.

As shown best at FIG. 3, one embodiment of the backpack can include a first PPE pocket that is specifically shaped and sized to hold and dispense disposable facemasks. To this end, the mask dispensing pocket 35 can be provided along the backpack, preferably alongside 15*b*, and can include an open top end 35*a*, and an elongated slit 35*c* extending downward toward the closed bottom end 35*b*. The pocket can also include a retention strap 36 having a connector 37 such as a snap, for example along a distal end for securing a box of disposable masks 3 within the pocket.

As is known, boxes of disposable masks are typically provided in packs of 50 and contained within a cardboard box. In the intended operation, the lid 3*a* of the cardboard box can be removed so as to allow the masks 3*b* to be individually retrieved. One suitable example of a commercially available box of disposable mask for use herein includes the 50-count 3 ply Disposable Face Masks PFE that is commercially available by Hygenix. Of course, other brands of masks are also contemplated.

In either instance, the pocket 35 can include a shape and a size that is complementary to the shape and size of a commercially available box of disposable masks, such as that described above, and the box can be inserted longitudinally within the pocket such that the open top end 3*a* is aligned with the elongated slit 35*c*. By providing an elongated slit that runs from the open top end of the pocket to the closed bottom end, and by aligning the box in the manner described above, individual masks 3*b* are advantageously able to be removed without having to bunch or deform their stored shape, thus causing deformities to the wire nose guide and possibly causing a rip in the mask material.

Figure 4:
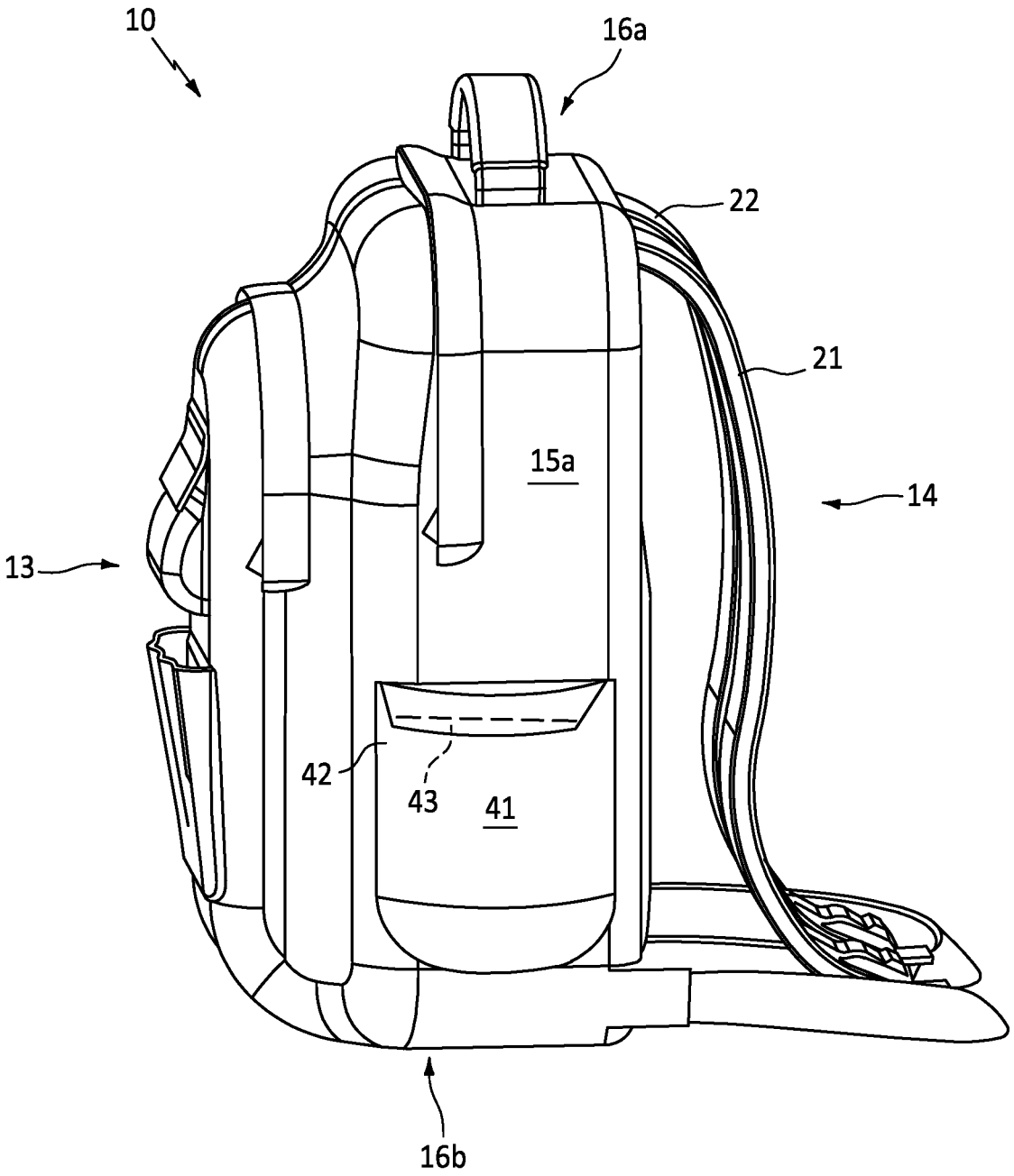
FIG. 4 is a side view of the backpack system in accordance with one embodiment of the invention.

As shown best at FIG. 4, one embodiment of the backpack can include a secondary PPE pocket 41 into which any number of personal items such as disposable gloves or self-defense equipment such as pepper spray, for example, can be positioned. The pocket will preferably be located along the bottom side of the bag so as to permit easy access by a user without having to take the bag off of their back. The pocket can include a cover 42 and a connector 43 such as hook and loop fasteners, for example, for allowing quick access to the pocket interior.

Figure 5:
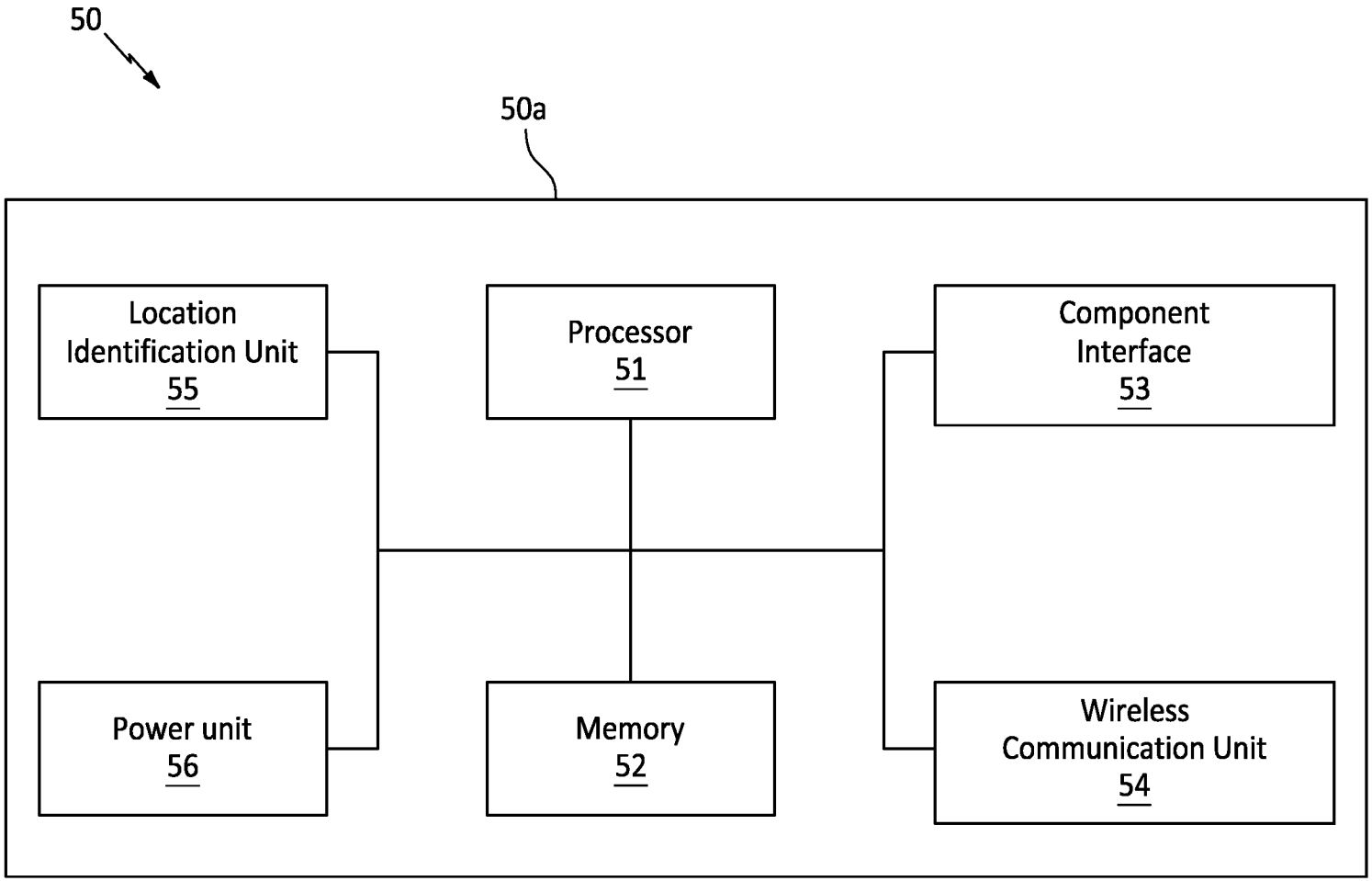
FIG. 5 a simplified block diagram of the system controller of the backpack system, in accordance with one embodiment of the invention.

FIG. 5 is a simplistic block diagram illustrating one embodiment of the system controller 50. The controller can be in electrical communication with each of the plurality of electronic components and can function communicate with and/or control the operation of the same. In one embodiment, the controller 50 can include a processing unit 51 that is conventionally connected to an internal memory 52, a component interface unit 53, a wireless communication unit 54, a location identification unit 55, and/or a power unit 56.

Although illustrated as separate elements, those of skill in the art will recognize that one or more system components 51-56 may include, comprise, or consist of one or more printed circuit boards (PCB) containing any number of integrated circuit or circuits for completing the activities described herein. The controller will preferably be housed within a protective, impact resistant and watertight enclosure 50*a*, such as plastic, for example, and can be secured within the main body of the backpack. Of course, any number of other analog and/or digital components capable of performing the described functionality can be provided in place of, or in conjunction with the described elements.

The processing unit 51 can include one or more central processing units (CPU) or any other type of device, or multiple devices, capable of manipulating or processing information such as program code stored in the memory 52 in order to allow the device to perform the functionality described herein.

Memory 52 can act to store operating instructions in the form of program code for the processing unit 51 to execute. Although illustrated in FIG. 5 as a single component, memory 52 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. In the preferred embodiment, the memory can function to store audiovisual information captured by the camera system 28.

The component interface unit 53 can function to provide a communicative link between the processing unit 51 and various system elements such as the lights 18, the camera system 28 and the alarm 30, for example. In this regard, the component interface unit can include any number of different components such as one or more PIC microcontrollers, standard bus, internal bus, connection cables, and/or associated hardware capable of linking the various components.

In one embodiment, the component interface unit can include, or can be connected to one or more cable plugs 53*a* such as a USB port for example which can function to supply power from the power unit to an external device such a cellular telephone or other such device, for example. Of course, any other means for providing the two-way communication between the system components can also be utilized herein.

The wireless communication unit 54 can include any number of components capable of sending and/or receiving electronic signals with another device, either directly or over a network. In one preferred embodiment, the communication unit 54 can include a cellular communicator/transceiver for communicating wirelessly with an external device such as the above-described smartphone 1 running the mobile application 11, for example. Of course, other embodiments are contemplated wherein the communication unit 54 includes a different type of transceiver such as a WiFi or Bluetooth device, for example.

In either instance, the wireless communication unit can be designed to allow a remote operator of the mobile application access to receive real time audiovisual information captured by the camera system, and to receive alerts if/when the alarm is triggered. The communication unit can also allow an app user to speak to the backpack wearer or others via the onboard microphone 28*d* and speaker 28*c*, thus allowing the camera system to function as a complete two-way voice and video communication system with the device running the mobile application.

The location identification unit 55 can function to provide real time location information (e.g., address, GPS coordinates, etc.) of the backpack system 10 at all times. In one embodiment, the location module can comprise a discrete GPS transceiver and antenna for communicating with a third-party location tracking company that provides tracking and/or location services for registered GPS enabled devices. Alternatively, or in addition thereto, the location unit can utilize the cellular transceiver of the device to interact with the mapping and location services offered by many different cellular service providers. In either instance, the captured location information can be stored by the onboard memory 52 and/or can be transmitted to a user device 1 via the mobile application 11 in real time.

The power unit 56 can function to supply the required power to each of the system components. In one embodiment, the power unit can comprise a plurality of onboard batteries which are grouped together to form a rechargeable battery pack. The power unit can be linked with the above-described plug 53*a*, so as to also supply power to a user's smartphone or other portable electronic device.

Accordingly, the above-described backpack system provides users with a plethora of health and physical safety components and allows for a parent or other individual to know the location of the wearer and/or to communicate with the wearer at all times. Although described herein with regard to a backpack, this is but one possible implementation of the inventive concepts. To this end, those of skill in the art will recognize that other forms of the invention can be formed as different type of enclosures such as a suitcase, duffle bag, purse or other type of carrying case without undue experimentation and without deviating from the scope and spirit of the inventive concepts described herein. Accordingly, the inventive concepts are not to be construed as limiting to a backpack.

As to a further description of the manner and use of the present invention, the same should be apparent from the above description. Accordingly, no further discussion relating to the manner of usage and operation will be provided.

As described herein, one or more elements of the backpack system with integrated health and physical safety components 10 can be secured together utilizing any number of known attachment means. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A backpack system, comprising:

a main body having a front surface, a back surface, a top end, a bottom end, a pair of sides and an interior space;

at least one pocket that is disposed along the main body, said pocket having a shape and size that is complementary to a box of disposable masks removably inserted within said pocket such that an open top end is in open communication with an elongated slit that runs from said open top end of said pocket toward a closed bottom end, wherein a wire nose guide portion of each disposable mask is undeformed by removal through said structurally aligned elongated slit in said pocket;

a camera that is disposed along the main body;

a speaker that is disposed along the main body;

a microphone that is disposed along the main body;

a controller that is in communication with each of the camera, the speaker and the microphone, said controller including a wireless communication unit having one or more transceivers in two-way communication with external devices.

2. The backpack system of claim 1, further comprising:

a first shoulder strap that is positioned along the back surface of the main body, said first shoulder strap including a sanitizing wipes pocket.

3. The backpack system of claim 2, further comprising:

a resilient slit along a top end of the sanitizing wipes pocket.

4. The backpack system of claim 3, wherein the sanitizing wipes pocket includes a watertight lining, and is configured to receive and store a plurality of moist sanitizing wipes to be dispensed through the resilient slit.

5. The backpack system of claim 2, further comprising:

a second shoulder strap that is positioned along the back surface of the main body, said second shoulder strap including a sanitizer bottle pocket.

6. The backpack system of claim 5, wherein the sanitizer bottle pocket includes a shape and a size that is complementary to a shape and a size of a bottle of hand sanitizer.

7. The backpack system of claim 6, wherein the sanitizer bottle pocket includes a top end having an opening through which a pump dispenser connected to the bottle of hand sanitizer is positioned.

8. The backpack system of claim 1, further comprising:

at least one light that is disposed along the main body.

9. The backpack system of claim 8, further comprising:

at least one battery that is positioned within the main body, said at least one battery being connected to each of the at least one light.

10. The backpack system of claim 9, further comprising:

at least one plug that is in electrical communication with the at least one battery, said at least one plug being configured to receive and provide power to a charging cable for a portable electronic device.

11. The backpack system of claim 9, further comprising:

an alarm device that is communicatively linked to each of the controller and the at least one battery.

12. The backpack system of claim 11, further comprising:

a switch that is connected to the alarm by a tether, wherein the alarm is selectively activated via a pulling motion of the tether.

13. The backpack system of claim 12, wherein the controller includes functionality for sending an alarm notification to the external device upon activation of the alarm.

14. The backpack system of claim 1, wherein the external device comprises a user interface device, and further comprising:

a mobile application having a set of programmatic instructions for execution on the user interface device, said mobile application including functionality for communicating directly with the wireless communication unit of the controller.

15. The backpack system of claim 14, wherein said communicating includes receiving audiovisual information from one of the camera, the speaker or the microphone in real time.

16. The backpack system of claim 14, wherein said communicating includes sending audiovisual for playback on one of the camera, the speaker or the microphone in real time.

17. The backpack system of claim 1, further comprising:

a pair of shoulder straps that extend outward from the back surface of the main body, wherein each of the pair of shoulder straps being lined with a ballistic resistant material.

18. The backpack system of claim 1, wherein at least a portion of the main body is constructed from a ballistic resistant material.

19. The backpack system of claim 1, wherein at least a portion of the main body is lined with a ballistic resistant material.

20. The backpack system of claim 1, further comprising:

a location identification unit that is positioned within the main body, said unit being configured to determine and report a physical location of the main body to the controller, and wherein the controller includes functionality for transmitting the determined location to the external device.

* * * * *